United States Patent [19]

Zerfahs

[11] 4,453,667

[45] Jun. 12, 1984

[54] BILL TRANSPORT SYSTEM FOR A FAREBOX

[75] Inventor: Arthur S. Zerfahs, Elk Grove, Ill.

[73] Assignee: Qonaar Corporation, Rolling Meadows, Ill.

[21] Appl. No.: 340,101

[22] Filed: Jan. 18, 1982

[51] Int. Cl.[3] ..... G07B 15/00

[52] U.S. Cl. ..... 232/7; 194/4 G

[58] Field of Search ..... 232/7, 9, 10, 11, 14, 232/15; 133/2, 3 F, 3 H, 3 G, 8 E; 194/4 G; 209/534

[56] References Cited

U.S. PATENT DOCUMENTS

| | | | |
|---|---|---|---|
| 2,995,976 | 8/1961 | Weingart | 209/534 X |
| 3,077,983 | 2/1963 | Middleditch | 209/534 |
| 3,485,358 | 12/1969 | Hooker | 209/534 |
| 3,922,557 | 11/1975 | Carnes, Jr. | 209/534 X |

*Primary Examiner*—Robert P. Swiatek

*Attorney, Agent, or Firm*—McDougall, Hersh & Scott

[57] ABSTRACT

A revenue receiving farebox having a mechanism for receiving and transporting bills and tickets, includes a first conveyor mechanism disposed adjacent a bill receiving slot for engaging bills and transporting same along a guide to a second conveyor mechanism. The first conveyor mechanism is disposed relative to the second conveyor mechanism such that a bill will simultaneously be engaged by each. The speed of the first conveyor mechanism is less than that of the second conveyor mechanism so as to accelerate a first bill relative to a second overlapping bill to effectuate a separation of the bills.

14 Claims, 3 Drawing Figures

BILL TRANSPORT SYSTEM FOR A FAREBOX

This invention relates generally to fareboxes such as used in the mass transit industry for receiving fares and more specifically to a farebox which utilizes a conveyor system to transport a dollar bill or a flexible ticket from an entry slot to a storage compartment.

The Farescan bus fare collection farebox made by Duncan Industries, a division of Qonaar Corporation, employs a single endless belt conveyor to transport bills or tickets from an entry feed slot to a vertical inspection window for verification by the driver. A pair of spaced apart switches sense the position of the bill and automatically stop the conveyor when a bill is properly positioned within the window for display. After inspection by the driver, the conveyor is activated causing the bill to be carried to a revenue storing compartment.

Although this type of farebox has generally proved successful, some problems have been encountered when successive overlapping bills are inserted, that is, when the leading edge of a second bill overlaps the trailing edge of a first bill. This problem is caused by the insertion of a second bill into the bill receiving slot before the first bill is completely advanced within the slot by the conveyor. Since the switches utilized to position the bill in the inspection window may also be utilized to provide bill counting data, the two overlapping bills would be counted as a single bill. This type of miscounting creates discrepancies between the amount recorded as having been received and the actual amount received.

It is an object of the present invention to overcome the problem of overlapping bills in a revenue collection system having a conveyor for transporting bills by providing an efficient and reliable means for separating overlapping bills.

A more specific object of the present invention is to provide a means for separating overlapping bills which also functions as the initial bill intake feeding mechanism.

SUMMARY OF THE INVENTION

The present invention is directed toward a revenue receiving farebox having a conveyor means for receiving and transporting bills and tickets. A first conveyor means is disposed adjacent a bill receiving slot for engaging bills and transporting the bills along a guide to a second conveyor means. The first conveyor means is separated from the second conveyor means by a distance less than the length of the bill so that the first and second conveyor means simultaneously engage each bill. The speed of the first conveyor means is less than that of the second conveyor means, such as for example 60% of the speed of the second conveyor means. Should a second bill be inserted into the bill receiving slot so as to overlap the trailing edge of a preceding bill, the leading bill will be accelerated relative to the trailing bill thereby effectuating a separation of the bills so that the bills proceed along the second conveyor means in spaced apart relationship.

DETAILED DESCRIPTION

Figure 1:
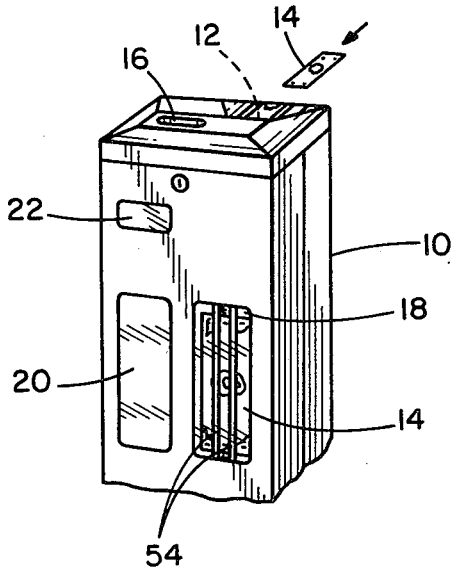
FIG. 1 is a partial perspective view of a farebox having a bill receiving slot and transport mechanism.

Referring in particular to FIG. 1, an exemplary farebox 10 includes a slot 12 for receiving a dollar bill 14 or a ticket, and a separate coin receiving slot 16. Upon inserting bill 14 into the slot 12, a transport mechanism which will be described below automatically advances the bill to a position opposite an inspection window 18. This permits the revenue collector to verify by visual inspection the deposited bill. Such a farebox may also contain an inspection window 20 for inspecting the coins deposited in slot 16. An electronic display 22 may be utilized to provide an automatic numerical display of the total fare deposited.

Conventional fareboxes of the type having a bill transport have employed a single endless belt conveyor system to advance a bill along a predetermined path. When the bill is positioned opposite inspection window 18, the conveyor is automatically stopped to permit a visual check. The conveyor is then started either manually or automatically to carry the bill from the window to a bill storage container.

Figure 3:
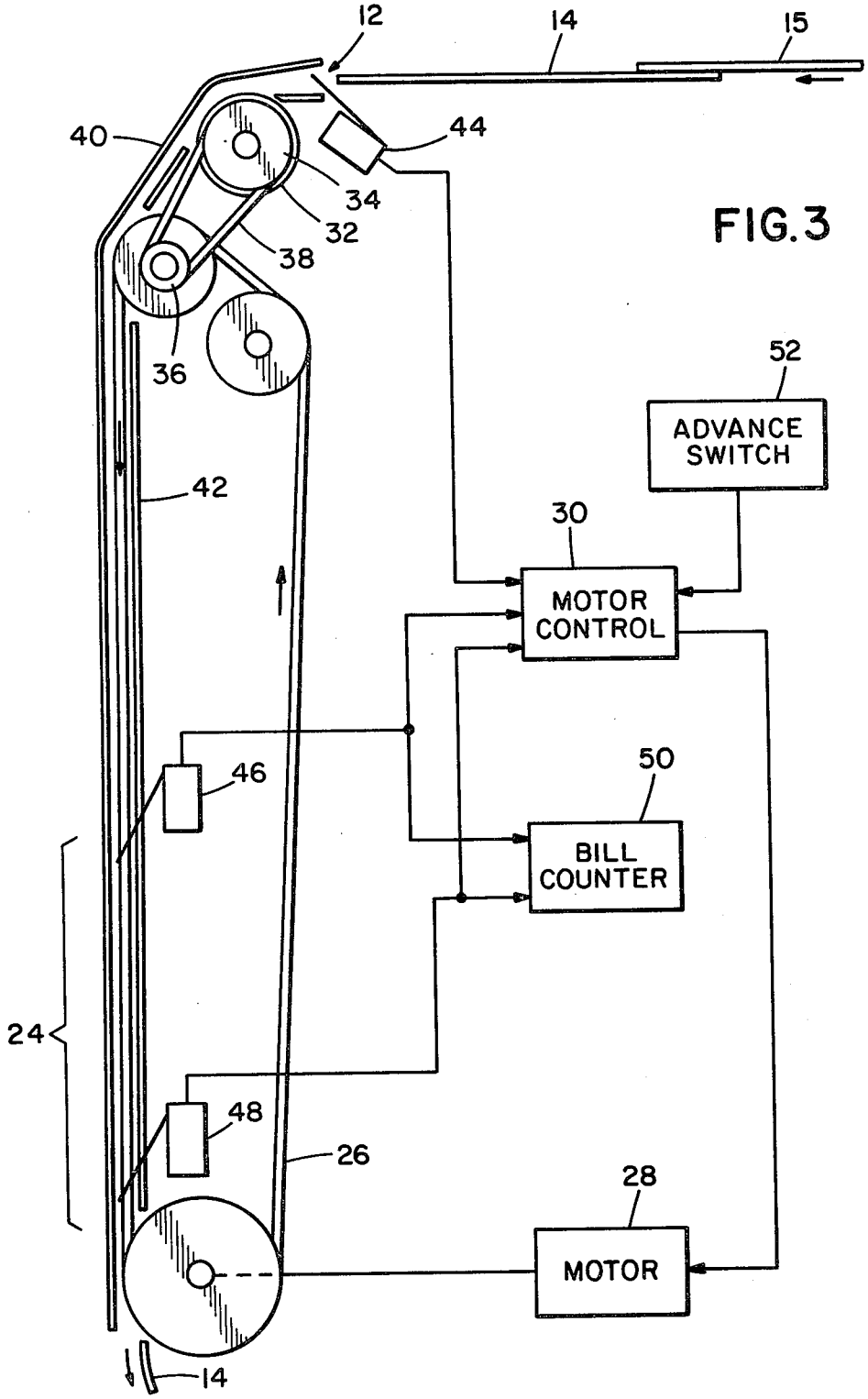
FIG. 3 is a diagrammatic representation of an embodiment of the present invention.

FIG. 3 diagrammatically illustrates an improved bill transport mechanism according to the present invention wherein a bill 15 will be inserted in overlapping relationship with a preceding bill 14 in slot 12. An endless conveyor belt 26 is driven in the direction as shown by the arrows by electric motor 28 which is responsive to motor control 30. An intake feed wheel 32 is driven at a lower peripheral speed than the speed of conveyor belt 26 by means of pulleys 34, 36 and drive belt 38. An outside wall 40 and inside wall 42 are illustrated in simplistic form.

In normal operation of the transport system generally illustrated in FIG. 3, a switch 44 senses the entry of a bill 14 into slot 12 which causes motor control 30 to energize motor 28 thereby driving belt 26 and wheel 32. The bill is advanced by wheel 32 to belt 26 which carries the bill to the general viewing position 24 wherein switches 46 and 48 are both closed. The motor control stops the motor to hold bill 14 opposite the inspection window. These switches also provide inputs to bill counter 50 which may comprise part of an electronic fare display or cumulative fare counter. Upon activation of advance switch 52 by the revenue collector, motor control 30 again energizes motor 28 causing bill 14 to be carried from the viewing position to a bill storage bin (not shown) at the exit end of belt 26.

When a second bill 15 is inserted in overlapping relationship with bill 14, intake wheel 32 cooperates with belt 26 so as to separate the bills before bill 14 reaches the viewing position 24. Such an overlap normally occurs as the result of a second bill being inserted into slot 12 before the trailing edge of an earlier bill 14 has been carried completely within the slot. When the leading edge of bill 14 engages wheel 32, it is accelerated to the peripheral speed of the wheel. When the edge of bill 14 engages belt 26, the bill will begin to accelerate until it reaches the same speed as belt 26, i.e., when the coefficient of friction between belt 26 and bill 14 is sufficiently great to cause slippage between the bill and wheel 32. Assuming the distance between wheel 32 and the initial point of bill engagement with belt 26 is greater than the length of overlap between the bills, at some point in time bill 14 will be engaged by belt 26 while bill 15 is engaged only by wheel 32. Hence bill 14 will accelerate relative to bill 15 separating the overlap between the bills before the leading bill reaches the viewing area.

If two overlapping bills were permitted to reach the viewing area, switches 46 and 48 would provide erroneous information to bill counter 50 since the switches would sense the passage of but a single bill. The purpose of the present invention is to separate initially overlapping bills so that counting, visual display, and any other desired further processing or sorting can be properly achieved.

Figure 2:
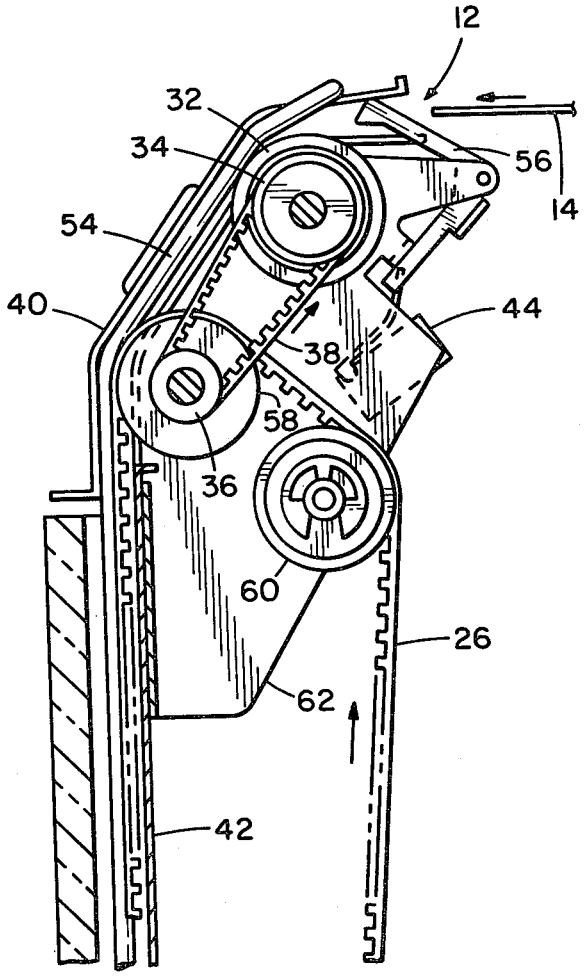
FIG. 2 is a partial side view of an embodiment of the present invention illustrating the relationship between the first and second conveying means.

FIG. 2 illustrates the construction of a preferred embodiment of the present invention in which the mechanism for maintaining a bill 14 in engagement with wheel 32 and thereafter engaged with belt 26 consists of two circular guide rods 54 (see FIG. 1) disposed adjacent and on opposite sides of the wheel and belt. The near guide rod is not shown in FIG. 2 for purposes of clarity of illustration. A pivotally mounted bracket 56 responds to the entry of bill 14 into slot 12 causing activation of switch 44. Preferably positive or toothed belts are utilized for drive belt 38 and conveyor belt 26 to prevent slippage. The periphery of wheel 32 which engages the bill and the engagement surface of belt 26 preferably have relatively high and approximately equal coefficients of friction per unit area such as by using a plastic material like Neoprene.

The difference in the diameters of pulleys 34 and 36 provides a speed reduction means for transferring drive from the conveyor belt to the intake wheel such that the peripheral speed of the wheel is less than the speed of the conveyor belt. Preferably the speed of the wheel is approximately 90% to 20% of the speed of the conveyor belt with a speed of approximately 60% having specifically proved satisfactory. A distance of approximately 1.25 inches between the engagement of the bill with the intake wheel and the initial point of engagement with the conveyor belt has proved satisfactory. The width of the conveyor belt and the width of the peripheral engagement surface of wheel 32 may be substantially equal such as between 0.25 inches and 0.5 inches.

As shown in FIG. 2, pulleys 58 and 60 guide endless belt 26 and may be conventionally mounted to a support bracket assembly 62. Outer guide wall 40 may consist of a metal guide plate. Transparent window 18 is preferably made of a plastic material and forms the outer wall for the remainder of the transport mechanism.

As illustrated in FIG. 2, a portion of the periphery of wheel 32 and the contact surface of belt 26 lie within a plane defined between the two parallel guide rods. This causes the bill to be slightly deformed and provides a means for engaging the bill. The ends of outer wall 40 and inner wall 42 define the slot 12 which serves to guide the bill to engagement between the intake wheel 32 and guide rails 54.

When a bill is inserted into a slot 12, it is advanced by intake wheel 32 towards belt 26 at the speed of the wheel. Although the precise mode of acceleration of the bill from the intake wheel to the higher speed of the belt is not totally clear, it is believed that as the area of contact between the bill and the surface of belt 26 increases, thereby increasing the frictional forces, the bill is gradually accelerated to the speed of the belt as the slippage between the bill and the wheel increases proportionally. It is the difference in speeds between the wheel and belt which effectuates the separation of overlapped bills. It should be noted that the overlap most common and which is specifically contemplated by the present invention is an overlap in which only a small length of a second bill overlaps a first bill, such as approximately one inch. When bills with such an overlap are inserted, the leading bill is accelerated relative to the trailing bill since the leading bill will achieve the same speed as belt 26 before the trailing bill engages the belt. Thus, for some period of time the leading bill will move faster than the trailing bill causing the bills to separate.

Although an embodiment of the present invention has been described above and illustrated in the drawings, the scope of the present invention is defined by the claims appended hereto.

It will be apparent to those skilled in the art that various changes and substitutions could be made without departing from the scope of the invention. For example, a gear drive or other means could be used to drive wheel 32, or the wheel could be driven by an independent motor.

What is claimed is:

1. In a revenue collecting farebox having a slot for receiving bills, the improvement in a transport means for separating a first and second bill inserted into said slot in overlapping relationship comprising:

(a) a first conveying means for advancing said bills;

(b) a second conveying means for receiving said bills from said first conveying means, said first and second conveying means disposed to simultaneously engage a bill;

(c) means for driving said first conveying means at a speed simultaneously less than the speed of said second conveying means, whereby said second conveying means will cause said first bill to move at a speed greater than said second bill while said second bill is engaged by said first conveying means thereby separating said first bill from overlapping relationship with said second bill.

2. The apparatus according to claim 1 wherein said first conveying means comprises a wheel.

3. The apparatus according to claim 2 wherein said wheel is disposed adjacent said slot for initially engaging a bill and advancing same to said second conveying means.

4. The apparatus according to claim 1 wherein said second conveying means comprises an endless belt and an electric motor for driving said endless belt.

5. The apparatus according to claim 1 wherein said driving means comprises a speed reduction means for driving said first conveying means from said second conveying means.

6. The apparatus according to claim 1 wherein said first conveying means has a substantially constant area of engagement with a bill.

7. The apparatus according to claim 1 or 6 wherein said second conveying means has an engagement area with a bill which increases from a minimum at initial engagement of the leading edge of the bill with said second conveying means to a maximum when the entire length of the bill is engaged by said second conveying means whereby the coefficient of friction between said second conveying means and a bill increases in proportion to the increasing area of engagement.

8. The apparatus according to claim 7 wherein the maximum area of engagement between the second conveying means and a bill is substantially larger than the area of engagement between a bill and said first conveying means.

9. The apparatus according to claim 1 wherein the speed of said first conveying means is within a range of 90% to 20% of the speed of said second conveying means.

10. The apparatus according to claim 1 wherein the coefficient of friction per unit area of said first conveying means is approximately equal to the coefficient of friction per unit area of said second conveying means.

11. The apparatus according to claim 1 wherein said second conveying means is positioned relative to said first conveying means so that a bill must be advanced beyond said first conveying means between one-half inch and three inches before engaging said second conveying means.

12. The apparatus according to claim 1 wherein the speed of the first conveying means is between about 20% and about 90% of the speed of the second conveying means.

13. The apparatus according to claim 1 wherein the speed of the first conveying means is about 60% of the speed of the second conveying means.

14. In a revenue collection farebox having a slot for receiving bills, the improvement in a transport means for separating a first and second bill inserted into said slot in overlapping relationship comprising:

(a) a first conveying means for advancing said bills;

(b) a second conveying means for receiving said bills from said first conveying means, said first and second conveying means disposed to simultaneously engage a bill;

(c) means for driving said first conveying means at a speed substantially less than the speed of said second conveying means, said driving means comprises a speed reduction means for driving said first conveying means from said second conveying means; said speed reduction means includes a first pulley coupled to said first conveying means, a second pulley coupled to said second conveying means, and a drive belt for driving said first pulley from said second pulley, whereby said second conveying means will cause said first bill to move at a speed greater than said second bill while said second bill is engaged by said first conveying means thereby separating said first bill from overlapping relationship with said second bill.

* * * * *